US010968541B2

(12) United States Patent
Blankenhorn et al.

(10) Patent No.: US 10,968,541 B2
(45) Date of Patent: Apr. 6, 2021

(54) AIR SPINNING MACHINE AND A METHOD FOR PRODUCING A YARN

(71) Applicant: Maschinenfabrik Rieter AG, Winterthur (CH)

(72) Inventors: Peter Blankenhorn, Gerstetten (DE); Christian Griesshammer, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 60 days.

(21) Appl. No.: 16/096,876

(22) PCT Filed: Apr. 18, 2017

(86) PCT No.: PCT/IB2017/052190
§ 371 (c)(1),
(2) Date: Oct. 26, 2018

(87) PCT Pub. No.: WO2017/187293
PCT Pub. Date: Nov. 2, 2017

(65) Prior Publication Data

US 2019/0136419 A1 May 9, 2019

(30) Foreign Application Priority Data

Apr. 29, 2016 (CH) ..... 00568/16

(51) Int. Cl.
*D01H 1/115* (2006.01)
*D01H 4/02* (2006.01)

(52) U.S. Cl.
CPC ..... *D01H 1/115* (2013.01); *D01H 4/02* (2013.01)

(58) Field of Classification Search
CPC . D01H 1/115; D01H 4/02; D01H 5/28; D01H 7/88; D01H 7/92
(Continued)

(56) References Cited

U.S. PATENT DOCUMENTS

2003/0101710 A1* 6/2003 Wust ..... D01H 1/115 57/328
2003/0177751 A1* 9/2003 Stalder ..... D01H 1/115 57/403
(Continued)

FOREIGN PATENT DOCUMENTS

CH 709756 A1 * 12/2015 ..... D01H 1/115
DE 10 2007 006674 A1 8/2008
(Continued)

OTHER PUBLICATIONS

Zeguang Pei et al., 2009, Textile Research Journal, vol. 79(14), pp. 1274-1280 accessed via https://journals.sagepub.com/doi/pdf/10.1177/0040517509102227 (last visited Feb. 13, 2020). (Year: 2009).*
(Continued)

*Primary Examiner* — Shaun R Hurley
*Assistant Examiner* — Patrick J. Lynch
(74) *Attorney, Agent, or Firm* — Dority & Manning, P.A.

(57) ABSTRACT

An air spinning machine for producing a yarn from a fiber structure includes a spinneret with an internal eddy chamber. A spindle in the spinneret has an intake opening and extends into the eddy chamber. An annular gap is formed between an outside surface of the spindle and an inside wall of the eddy chamber. Air jets in the spinneret introduce air into the eddy chamber to impart twist to the fiber structure at the intake opening. An interior draw-off channel in the spinneret has a longitudinal axis by means of which the yarn is withdrawn from the eddy chamber. The air jets are aligned in a direction relative to a front side of the spindle around the intake opening so that some of the air introduced via the air jets during a spinning operation enters the annular gap and a remainder of the air enters the draw-off channel.

11 Claims, 9 Drawing Sheets

(58) Field of Classification Search
USPC ..... 57/350, 333
See application file for complete search history.

(56) References Cited

U.S. PATENT DOCUMENTS

| | | | | |
|---|---|---|---|---|
| 2004/0025488 | A1* | 2/2004 | Anderegg | D01H 1/115 57/400 |
| 2014/0208711 | A1* | 7/2014 | Griesshammer | D01H 15/00 57/333 |
| 2015/0240394 | A1* | 8/2015 | Blankenhorn | D01H 1/115 57/333 |
| 2015/0284878 | A1* | 10/2015 | Kubler | D01H 1/115 425/461 |
| 2015/0361594 | A1* | 12/2015 | Fischer | D01H 13/22 53/296 |

FOREIGN PATENT DOCUMENTS

| | | | | |
|---|---|---|---|---|
| DE | 10 2012 108613 | A1 | 3/2014 | |
| DK | 102012101039 | A1 * | 8/2013 | D01H 1/115 |
| JP | 2008 297688 | A | 12/2008 | |
| WO | WO-2004048655 | A1 * | 6/2004 | D01H 4/02 |
| WO | WO 2014/041412 | A2 | 3/2014 | |

OTHER PUBLICATIONS

DE102012101039, to Kuebler et al., translation via espacenet.com (last visited Feb. 21, 2020) (Year: 2013).*

Zeguang Pei et al: "Study on the Principle of Yarn Formation of Murata Vortex Spinning Using Numerical Simulation", Textile Research Journal, Bd. 79, Nr. 14, 2009, Seiten 1274-1280, XP055390395, GB.

Leilei Sun et al: "Effects of structural parameters on the tangentially injected swirling flow in concentric tubes with different lengths as a model of the vortex spinning nozzle", Textile Research Journal, Bd. 86, Nr. 12, Oct. 5, 2015 (Oct. 5, 2015), Seiten 1241-1258, XP055390398, GB.

PCT Search Report, dated Jul. 25, 2017.

Swiss Patent Office Search Report, dated Jul. 19, 2016.

* cited by examiner

AIR SPINNING MACHINE AND A METHOD FOR PRODUCING A YARN

FIELD OF THE INVENTION

The present invention relates to an air spinning machine for producing a yarn from a fiber structure, wherein the air spinning machine includes at least one spinneret having an eddy chamber, the eddy chamber having an inlet for admission of the fiber structure. The spinneret includes a yarn-forming element in the form of a spindle having an intake opening, the yarn-forming element extending at least partially into the eddy chamber. An annular gap is formed between an outside surface of the spindle and an inside wall of the eddy chamber facing the spindle. The spinneret includes air jets through which air can be introduced into the eddy chamber to impart a twist to the fiber structure during a spinning operation following a spinning start operation of the spinneret in the region of the intake opening of the spindle. The spindle has an internal draw-off channel having a longitudinal axis over which the yarn can be drawn off from the eddy chamber.

In addition, a method for producing a yarn from a fiber structure during a spinning operation which follows a spinning start operation with the help of an air spinning machine is proposed, wherein the air spinning machine includes at least one spinneret with an eddy chamber, the eddy chamber receiving a fiber structure through an intake. The spinneret includes a yarn-forming element extending at least partially into the eddy chamber and embodied in the form of a spindle having an intake opening. An annular gap is formed between the outside surface of the spindle and the inside wall of the eddy chamber facing the spindle. The spinneret includes air jets, by means of which air is introduced into the eddy chamber during spinning operation to impart a twist to the fiber structure in the area of the intake opening of the spindle. The spindle has an internal draw-off channel, and a draw-off channel having a longitudinal axis, through which the yarn is drawn out of the eddy chamber.

BACKGROUND

Air spinning machines with corresponding spinnerets are known in the prior art and are used to produce a yarn from an elongated fiber structure. The outer fibers of the fiber structure are wound around the interior core fibers with the help of an eddy air current created by the air jets inside the eddy chamber in the area of an intake opening of the yarn-forming element and thereby form the wound fibers that are characteristic of the desired strength of the yarn. This results in a yarn with a true twist which is ultimately discharged from the eddy chamber through a draw-off channel and can be wound onto a sleeve for example.

In the sense of the present invention in general, the term yarn is also understood to refer to a fiber structure, in which at least some of the fibers are wound around an interior core. Therefore, this includes a yarn in the traditional sense which can be processed with the help of a weaving machine for example to form a fabric. Also however the invention also relates air spinning machines with the help of which so-called roving (another term is slubbing or card sliver) can be produced. This type of yarn is characterized in that, despite having a certain strength sufficient to transport the yarn to a downstream textile machine, it is still capable of being drawn. The roving can thus be drawn before the final spinning with the help of a drawing device, for example, the stretching device of a textile machine that processes the roving, for example, a ring spinning machine.

In the area of the intake of the spinneret, a fiber guide element by means of which the fiber structure is guided into the spinneret and ultimately into the region of the yarn forming element is usually arranged in the area of the intake, wherein spindles having an interior draw-off channel are used as yarn-forming elements.

In the area of the front side of the spindle surrounding the intake opening, compressed air is introduced into the eddy chamber through the air jets, so that ultimately the aforementioned rotating eddy air current is obtained due to the corresponding alignment of the air jets. As a result, individual exterior fibers are separated from the fiber structure leaving the fiber guide element and/or are drawn out of the fiber structure for a distance and wrapped around the front side of the spindle. In the remaining course, these fibers rotate on the surface of the spindle. Subsequently, due to the forward movement of the interior core fibers of the fiber structure, the rotating fibers are wound around the core fibers, thereby forming the yarn.

In addition to the pressure of the air introduced through the air jets and the geometry of the spinneret, the spindle in particular and the eddy chamber are of crucial importance for the formation of the yarn.

SUMMARY OF THE INVENTION

An object of the present invention is to propose and air spinning machine and/or a method with the help of which a particularly high quality yarn can be produced. Additional objects and advantages of the invention will be set forth in part in the following description, or may be obvious from the description, or may be learned through practice of the invention.

The objects are achieved by an air spinning machine, as well as a method, having the features set forth herein.

According to the invention, an air spinning machine for producing a yarn from a fiber structure is proposed, wherein the air spinning machine includes at least one spinneret with an eddy chamber. The eddy chamber has an intake in the form of an opening, which is preferably bordered and/or defined by a fiber guide element, and by means of which the fiber structure is introduced into the eddy chamber during the spinning operation and/or is drawn into the eddy chamber due to the vacuum prevailing inside the eddy chamber.

The term "spinning operation" is understood in the context of the present invention to refer to operation of the air spinning machine, in which a yarn is produced from the fiber structure supplied to it with the help of the corresponding spinneret(s) and is wound onto a sleeve with the help of a bobbin device. In contrast with that, a connection between the fiber structure and the end of the yarn produced previously also takes place during the aforementioned spinning start operation. This is necessary to make it possible to continue with the spinning operation.

In any case, there is an annular gap between an outside surface of the spindle, which preferably has rotational symmetry, and an inside wall of the eddy chamber facing the spindle. This annular gap forms a part of the eddy chamber, and the aforementioned eddy air current develops here at least during the spinning operation.

Finally, the spinneret usually includes an air suction ventilator by means of which the air introduced previously through the air jets can escape from the eddy chamber. An air demand develops in the area of the front end of the spindle, this demand being met by the air jets via the intake of the eddy chamber and via the draw-off channel, through which the yarn is drawn out of the spindle.

The air flowing through the draw-off channel, in particular in the opposite direction from the direction of transport of the yarn inside the draw-off channel, has a negative effect on the yarn because its direction of flow is opposite the movement of the yarn and retards the latter and/or exerts unwanted forces on the fiber ends.

Therefore, it is now proposed according to the invention that the air jets be aligned in the direction of the front end of the spindle surrounding the intake opening in such a way that some of the air introduced through the air jets during spinning operation enters the ring gap and the remaining amount of air enters the draw-off channel.

In other words, the alignment of the air jets is thus such that some of the compressed air introduced through the air jets travels at least a short distance into the draw-off channel, where it counteracts the air flow tending in the opposite direction within the draw-off channel. Depending on the air pressure of the air leaving the air jets, and depending on the alignment of the air jets, the air entering the draw-off channel through the intake opening of the spindle can now leave through the draw-off channel and thus prevent the unwanted air flow in the direction opposite the transport direction of the yarn within the draw-off channel.

Alternatively, it is also conceivable for the air that is introduced through the intake opening to travel only a certain distance into the draw-off channel where it undergoes a change in direction due to the air flowing in the opposite direction. In this case, various directions of flow of the air flowing in the draw-off channel prevail there, so that at least some of the air originating from the air jets can also exit from the spindle again, traveling opposite the direction of transport of the yarn.

In any case, when the air enters the draw-off channel in the direction opposite the direction of transport of the yarn, in contrast with the prior art, a force opposes the air entering the draw-off channel opposite the direction of transport of the yarn due to the air introduced through the spinnerets in the transport direction of the yarn. Ultimately, this force reduces the volume flow of the air flowing opposite the direction of transport through the draw-off channel in comparison with an approach, in which the air introduced by the air jets is emitted only into the annual gap in the eddy chamber.

Details about possible alignments of the air jets are explained in greater detail below.

It is particularly advantageous if each of the air jets in a plane containing the intake opening (said plane extending in particular at a right angle to a longitudinal axis of the spindle) each run between the intake opening and a tangent to the inside wall of the eddy chamber running parallel to a central axis of the respective air jet. Therefore, the air jets do not open tangentially into the eddy chamber. Instead they are shifted in parallel in the direction of the longitudinal axis of the spindle (extending along the draw-off channel) with respect to a tangential arrangement, so that they are shifted radially (based on the aforementioned longitudinal axis), i.e., situated closer to the intake opening of the spindle in comparison with the prior art. This promotes the desired effect, namely that some of the air is introduced into the draw-off channel via the air jets.

It is advantageous if the air jets are in the form of holes, each with a central axis. It is also advantageous if the shortest distance a between the corresponding central axis and a reference plane running parallel to this central axis and containing the longitudinal axis of the spindle at a right angle to the respective central axis, conforms to the formula $a=d/2+D/2+b$, where d is the inside diameter of the air jet, D is the inside diameter of the draw-off channel in a cylindrical region adjacent to the intake opening, and b is the remaining distance between the inside of an air jet facing the draw-off channel and the inside surface of the spindle facing this air jet and/or its draw-off channel in the region of the cylindrical section of the draw-off channel downstream from the intake opening of the spindle.

Furthermore, "a" has a value of −0.7 mm to 8.0 mm (preferably from 0.0 mm to 7.0 mm, especially preferably from 0.4 mm to 6.5 mm). D has a value of 0.4 mm to 12.0 mm (preferably of 0.6 mm to 10.0 mm, especially preferably of 0.8 mm to 8.0 mm) and d has a value of 0.2 mm to 2.0 mm (preferably of 0.3 mm to 1.5 mm, especially preferably of 0.4 mm to 1.2 mm). Ultimately it is proven especially advantageous if b has a value of −1.5 mm to 5.0 mm (preferably of −1.0 mm to 3.0 mm, especially preferably from −0.3 mm to 2.0 mm).

The following values have proven suitable when the spindle used is a spindle for producing a roving (i.e., yarn that must be subjected to an additional spinning operation before a subsequent possible weaving step):

a: 1.5 mm to 8.0 mm (preferably 2.5 mm to 6.5 mm, especially preferably from 3.5 mm to 5.5 mm),
b: −1.5 mm to 5.0 mm (preferably −1.0 mm to 3.0 mm, especially preferably from 0.0 mm to 2.0 mm),
d: 0.4 mm to 2.0 mm (preferably 0.5 mm to 1.2 mm, especially preferably 0.6 mm to 1.0 mm),
D: 2.0 mm to 10.0 mm (preferably 4.0 mm to 8.0 mm, especially preferably 5.0 mm to 7.0 mm).

However, if a spindle is used to produce traditional yarn (i.e., yarn that can be processed to a fabric with the help of a weaving machine without any additional spinning process, then the following values have proven to be especially advantageous:

a: −0.7 mm to 5.6 mm (preferably 0.0 mm to 4.2 mm, especially preferably from 0.4 mm to 3.1 mm),
b: −1.0 mm to 3.5 mm (preferably −0.5 mm to 2.75 mm, especially preferably from −0.25 mm to 2.0 mm),
d: 0.3 mm to 1.2 mm (preferably 0.4 mm to 0.8 mm, especially preferably 0.5 mm to 0.7 mm),
D: 0.4 mm to 3.0 mm (preferably 0.6 mm to 2.0 mm, especially preferably 0.8 mm to 1.5 mm).

It is also advantageous if b has a value less than half the inside diameter D of the draw-off channel. The respective air jet in this case is relatively close to the draw-off channel and/or the intake opening of the spindle, which thus ensures that some of the air introduced through the air jets will enter the draw-off channel.

It should be pointed out in general here that the spinnerets should usually have an air outlet opening, which should be situated between the intake of the eddy chamber and the intake opening of the spindle, based on the longitudinal axis of the spindle.

It is also advantageous if b has a value less than the wall thickness of the spindle in a cylindrical region of the spindle connected to the intake opening. The wall thickness here is understood to be the radial thickness of the spindle wall, based on the longitudinal axis of the spindle. In particular, it is advantageous if b has a value between 50% and 90% of the value of the aforementioned wall thickness.

It is also advantageous if the air jets are designed as holes, such that an imaginary linear extension of the respective air jet intersects with the spindle, i.e., with the spindle wall bordering the draw-off channel. In contrast with that, it is customary in the prior art for the aforementioned extension to run through the annular gap of the eddy chamber without striking the spindle. The extension having a cylindrical shaped may intersect the spindle such that the sectional surface running a right angle to the extension is trough shaped. In particular, however, it may be advantageous if the air jets are aligned in such a way that, although the imaginary extension of the spinnerets has a sectional surface with the spindle, the imaginary straight extension of the central axis does pass by the spindle without intersecting it.

In particular, however, it is advantageous if an imaginary linear extension of the central axis of the respective air jet intersects the spindle. In this case, the central axis and therefore also the corresponding air jet are situated especially close to the spindle and/or its intake opening, so this ensures in a particularly reliable manner that at least some of the air coming out of the air jets will enter the draw-off channel.

In general, the extension of the central axis of the respective air jet and/or the extension of the air jet itself can intersect the spindle in the area of its outer surface.

In addition, it is advantageous if the extension of the respective central axis intersects the spindle in the area of the spindle wall without thereby intersecting the inside surface of the spindle, which borders the draw-off channel. In this case, too much of the air introduced through the air jets would enter the draw-off channel, so that it would be difficult to maintain the eddy air current outside of the spindle.

It is also advantageous if the imaginary extension of the respective air jet and/or the imaginary extension of the central axis of the respective borehole intersect(s) the spindle in the area of its front side. It may also be advantageous in particular if the extension of the respective air jet intersects the spindle in the area of the front side and in the area of its outer surface. For example, the extension may intersect the spindle first in the area of the front side and in the remaining course, because of the skewed position of the borehole and the draw-off channel, also in the area of the spindle wall.

The method already addressed in the introduction is ultimately characterized in that some of the air introduced into the eddy chamber with the help of air jets during the spinning operation of a corresponding air spinning machine enters into the annular gap already described and some of it enters the draw-off channel. With regard to the advantages in this regard, reference is made to the preceding description and that the following description.

Furthermore, it should be pointed out explicitly here that the air spinning machine has one or more of the features described previously or below. Likewise, the air spinning machine described above may have a control and/or regulating unit designed to operate the air spinning machine according to the method described in the context of the present invention.

Special advantages are achieved when at least some of the air introduced into the eddy chamber with the help of the air jets during the spinning operation strikes the front side of the spindle surrounding the intake opening of the spindle and thereby is divided by the spindle in the aforementioned manner. The front side which should generally be designed as a ring in a view from above in this case acts as a kind of impact surface against which the air strikes and is thereby divided into the two fractions which enter either the annular gap or the draw-off channel. Although other possibilities for dividing the air cannot be ruled out, this possibility can be accomplished from a structural standpoint, merely through the position and orientation of the air jets.

In addition, it is advantageous if the air is introduced into the eddy chamber with the help of the air jets during the spinning operation in such a way that most of the air thereby introduced enters the annular gap. The air flowing through the air jets thus mainly induces the eddy air current required for yarn production inside the eddy chamber, while the rest of the air enters the draw-off channel and thereby suppresses the air flow passing through the draw-off channel in the opposite direction from the direction of transport of the yarn or at least reduces it in comparison with the prior art.

It is especially advantageous if the air introduced into the eddy chamber with the help of the air jets during spinning operation in such a way that max. 30% preferably max. 10% especially preferably max. 5%, of the air introduced enters the draw-off channel. The remaining amount enters the annular gap and ultimately leaves the spinneret through a corresponding suction exhaust.

BRIEF DESCRIPTION OF THE DRAWINGS

Additional advantages of the invention are described in the following embodiments. In the schematic drawings.

DETAILED DESCRIPTION

Figure 1:
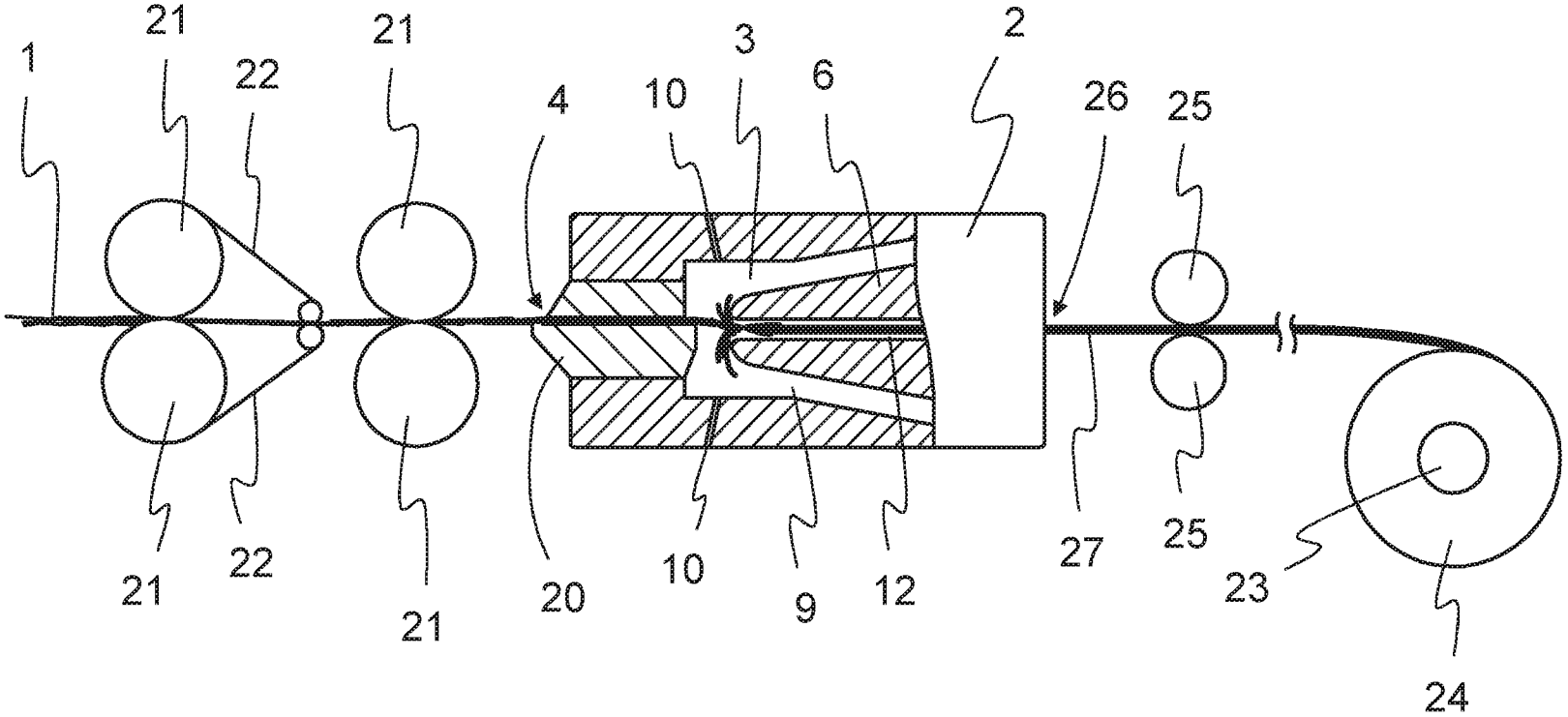
FIG. 1 shows a side view of a detail of an air spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic view of a detail of an air spinning machine. The air spinning machine may comprise as needed a drawing device having a plurality of drawing device rollers 21 and individual small belts 22 as needed, wherein the drawing device is supplied with a fiber structure 1 for example in the form of a doubled drawn sliver during the spinning operation.

Furthermore, the air spinning machine shown here has one or more spinnerets 2 arranged next to one another, each having an interior eddy chamber 3 in which the fiber structure 1 and/or at least some of the fibers of the fiber structure 1 are provided with a twist (the exact mode of operation of the spinneret 2 is described in greater detail below).

In addition, the air spinning machine may comprise a plurality of cooperating draw-off rollers 25 as well as a winding device (not shown), which is downstream from the draw-off rollers 25 and with the help of which the yarn 27 leaving the spinneret 2 through on outlet 26 can be wound onto a sleeve 23 to form a bobbin 24. The air spinning machine according to the invention need not necessarily have a drawing device as illustrated in FIG. 1. The draw-off rollers 25 are not absolutely necessary.

The spinning machine shown here operates according to an air spinning method. To form the yarn 27, the fiber structure 1, arranged above an intake 4, in which a so-called fiber guide element 20 is preferably arranged, is guided into the eddy chamber 3 of the spinneret 2 (see also FIG. 2), where it receives a twist, i.e., at least some of the free fiber ends of the fiber structure 1 are captured by an air stream created by air jets 10 arranged suitably in an eddy chamber wall 29 surrounding the eddy chamber 3. Some of the fibers here are pulled at least a certain distance out of the fiber structure 1 and wound around the tip of a yarn-forming element, which is in the form of a spindle 6 protruding into the eddy chamber 3. Ultimately, the free fiber ends are also drawn in the direction of the intake opening 5 and are thereby wrapped as so-called winding fibers around the core fibers running centrally, resulting in a yarn 27 having the desired twist because the fiber structure 1 is drawn off through a draw-off channel 12 arranged inside the spindle 6 and out of the eddy chamber 3 by an intake opening 5 arranged in the area of the front side 13 of the spindle 6, facing in the direction of the intake 4.

In general, it should be clarified at this point that the yarn 27 produced may fundamentally be any fiber structure, which is characterized in that an exterior portion of the fibers (so-called winding fibers) is wrapped around an inner portion of the fibers, preferably without a twist, to impart the desired strength to the yarn 27.

The invention also includes an air spinning machine with the help of which the so-called roving can be produced. Roving is yarn 27 have a relatively small amount of winding fibers and/or a yarn 27, in which the winding fibers are wound relatively loosely around the inner core, so that the yarn 27 remains drawable. This is crucial, for example, when the yarn 27 that is produced is or must be drawn again with the help of a drawing device on a downstream textile machine (for example, a ring spinning machine) to be suitable for further processing.

With regard to the air jets 10, it should be pointed out here again as a purely precautionary measure that such air jets should usually be aligned in such a way that jointly they created an air flow having a uniform direction of twist in the same direction. The individual air jets 10 here are arranged in rotational symmetry to one another.

Figure 2:
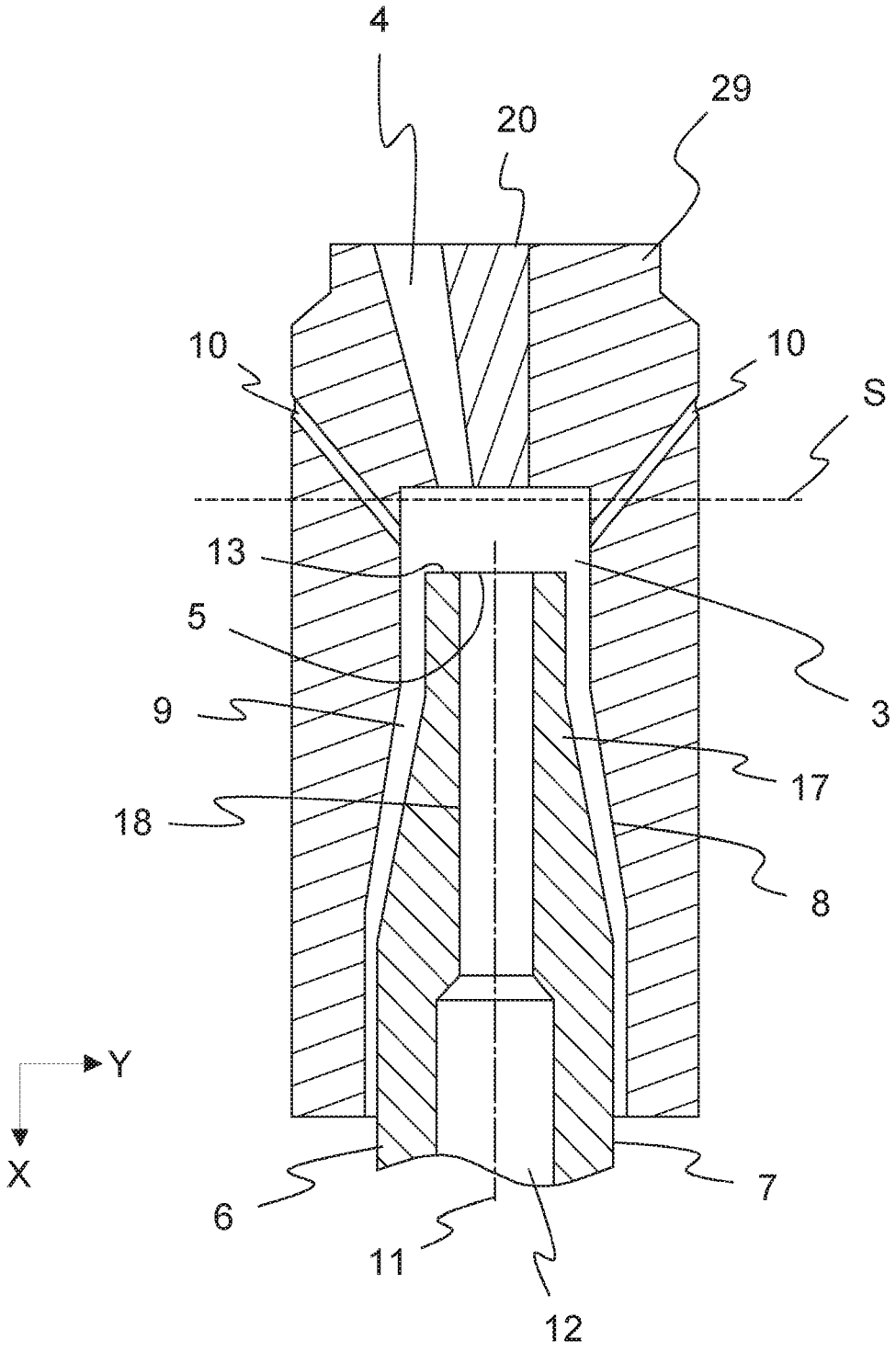
FIG. 2 shows a cross section through a detail of a known spinneret.

Furthermore, FIG. 2 shows that an annular gap 9, preferably running at least partially in rotational symmetry with the longitudinal axis 11 of the spindle 6, is formed between the outer surface 7 of the spindle 6 and the inside wall 8 of the eddy chamber 3 (i.e., the surface of the eddy chamber wall facing in the direction of the spindle 6). In the approaches known so far, all of the air introduced through the air jets 10 would leave the eddy chamber 3 via this annular gap 9, wherein the air would usually be drawn off downward through an air suction exhaust (not shown) out of the annular gap 9 (based on FIG. 2).

Figure 3:
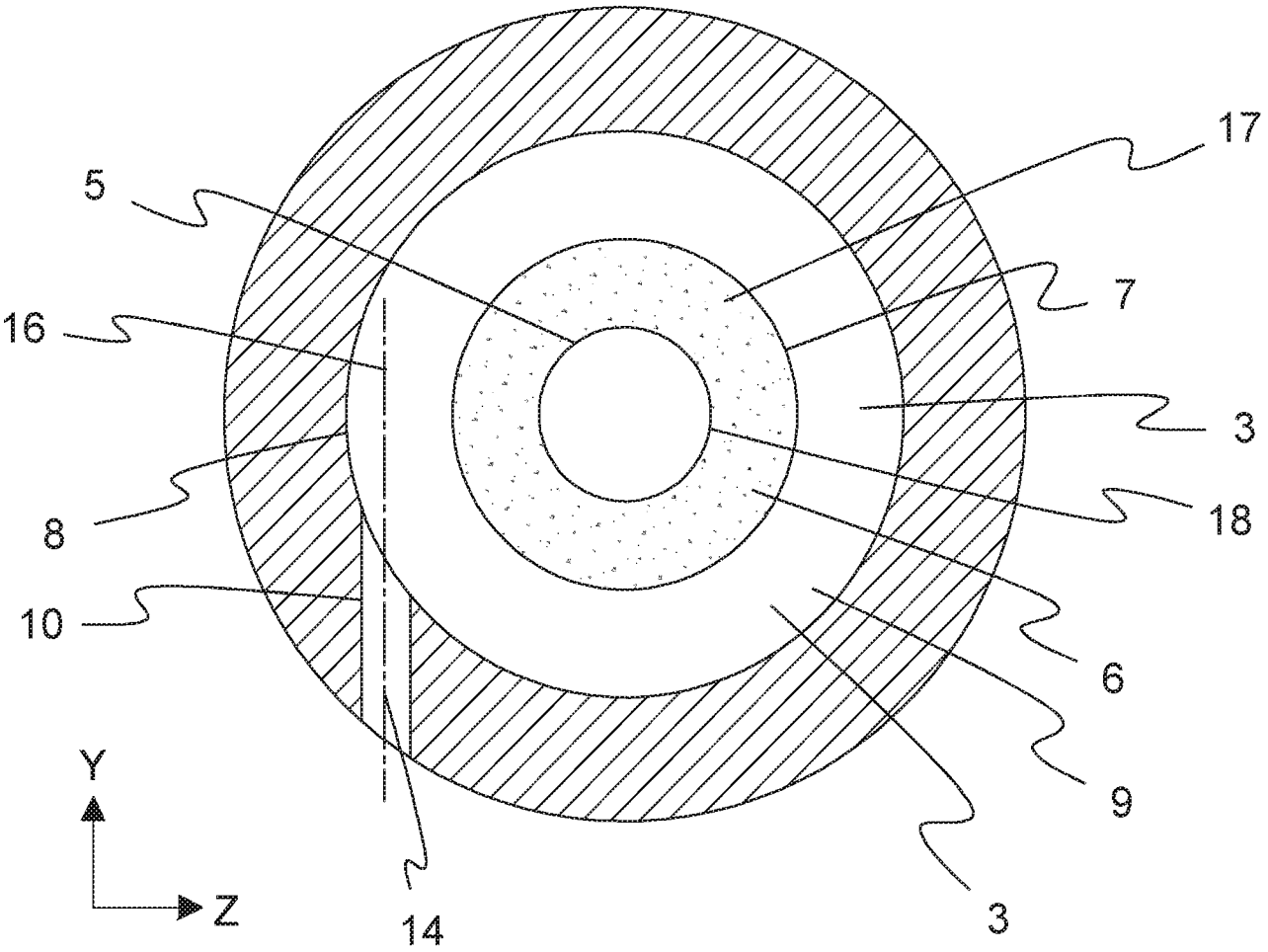
FIG. 3 shows a sectional diagram of the spinneret illustrated in FIG. 2 with a section along the interface S.

In this context, reference should also be made to FIG. 3, which shows a section of the spinneret 2 illustrated along the sectional plane in FIG. 2, shown here along the sectional plane S. The air jets 10 are projected into the sectional plane S for the sake of better comprehensibility. The same thing is also true of FIGS. 4 through 6, which are described in greater detail below.

FIG. 2 indicates, the known state-of-the-art air jets 10 are explicitly oriented in such a way that all of the air 28 (FIG. 5) introduced enters the annular gap 9 between the eddy chamber wall 29 and the spindle 6 because this was hoped to yield a particularly homogenous eddy air flow (which is also the reason why the known state-of-the-art air jets 10 open tangentially into the eddy chamber 3). The imaginary extension 16 of the central axis 14 of the respective air jet 10 (only one of several of which is shown in FIGS. 3 through 6 for reasons of simplicity) does not intersect the spindle wall 17 in this case.

Whereas the resulting vacuum in the area of the fiber guide element 20 is important for drawing the fiber structure 1 through the intake 4 into the spinneret 2, it also causes an unwanted air flow, which extends from the outlet 26 of the spinneret 2 through the draw-off channel 12, which is bordered by an inside surface 18 of the spindle 6, in the direction of the intake opening 5 of the spindle 6 and results in a negative effect on the yarn quality.

Therefore, in contrast with the prior art, it is now proposed that the air jets 10 should be oriented in such a way that some of the air 28 introduced into the eddy chamber 3 via the air jets 10 should enter the annular gap 9 and some of it should enter the draw-off channel 12 through the intake opening 5.

Figure 4A:
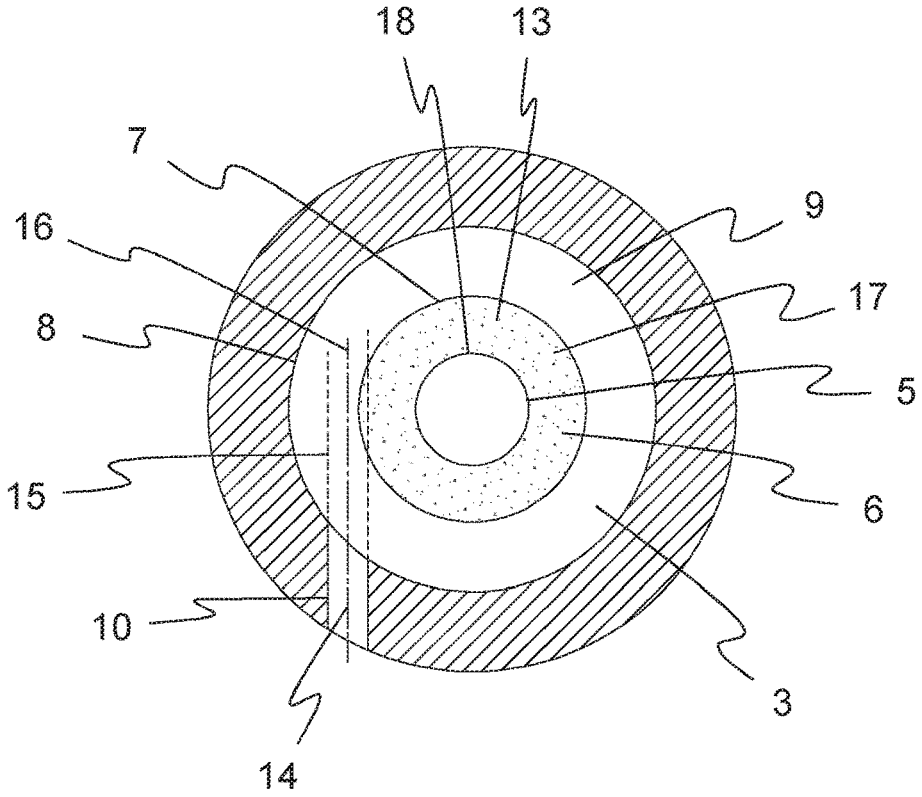
FIGS. 4*a*, 4*b* show sectional diagrams of spinnerets according to the invention.
Figure 4B:
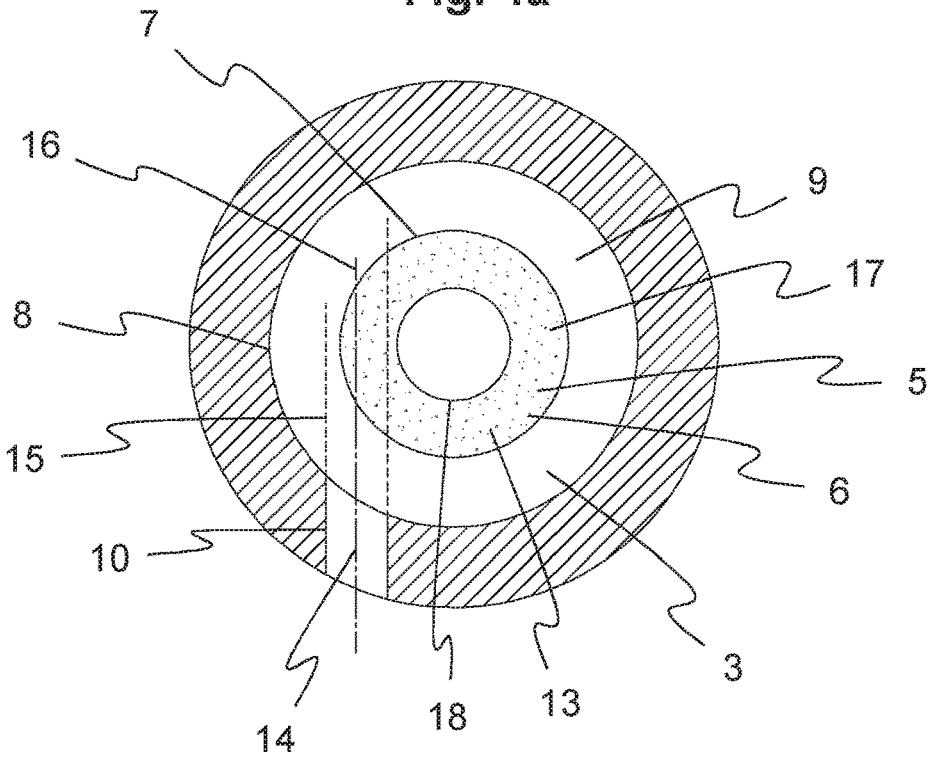

Possible orientations are illustrated in FIGS. 4*a* and 4*b* which correspond in principle to the representations in FIG. 3 (i.e., here again the air jets 10 are projected into the sectional plane).

In contrast with the orientation of the air jets 10 shown in FIG. 3, the air jets 10 shown in FIGS. 4*a* and 4*b* are shifted in the direction of the draw-off channel 12, so that they no longer open tangentially into the eddy chamber 3. Whereas the shift in FIG. 4*a* has taken place in such a way that the imaginary extension 16 of the central axis 14 of the respective air jet 10 runs outside of the spindle 6, said extension 16 in the case of FIG. 4*b* intersects the spindle wall 17.

In both cases, however, the air jet 10 is aligned in such a way that its imaginary extension 15 intersects the spindle wall 17. Said extension 15 of the air jet 10 and the front side 13 of the spindle 6 thus overlap in the top view shown in FIGS. 4*a* and 4*b*.

Figure 5:
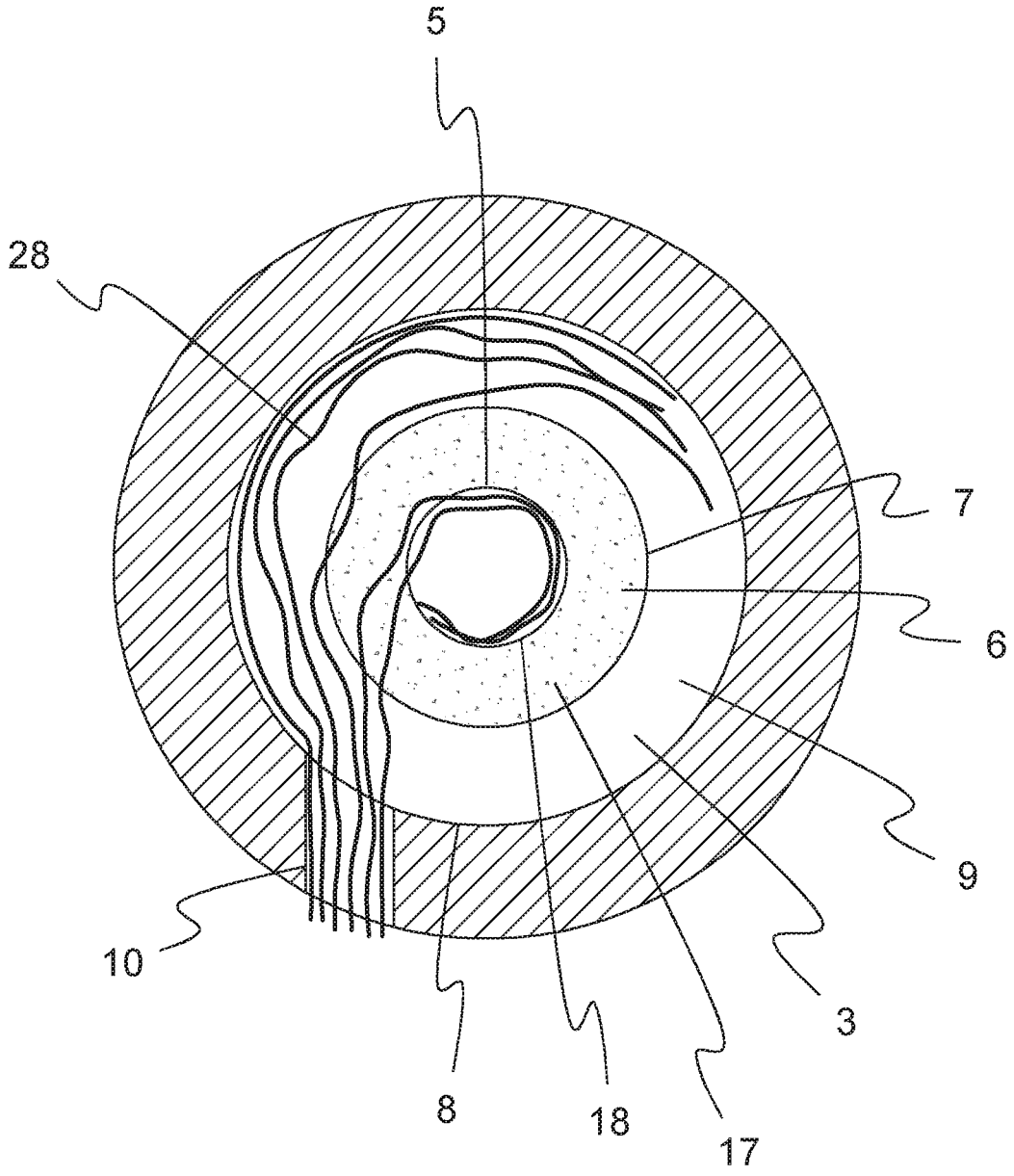
FIG. 5 shows a possible air flow within the spinneret shown in FIG. 4*b;*

The effect of this alignment is now shown schematically in FIG. 5 where the variant shown in FIG. 4*b* is illustrated. As illustrated graphically by the path of the air 28, some of the air 28 introduced by the air jets 10 into the eddy chamber 3 enters the annular gap 9, while the rest of the air 28 enters the draw-off channel 12. This amount of introduced air 28 then means that relatively little air 28 or none at all can flow opposite the direction of transport of the yarn 27 through the draw-off channel 12, i.e., from the inlet 26 of the spinneret 2 in the direction of the intake opening 5 of the spindle 6. This permits production of a yarn 27 of a particularly high quality.

Figure 6:
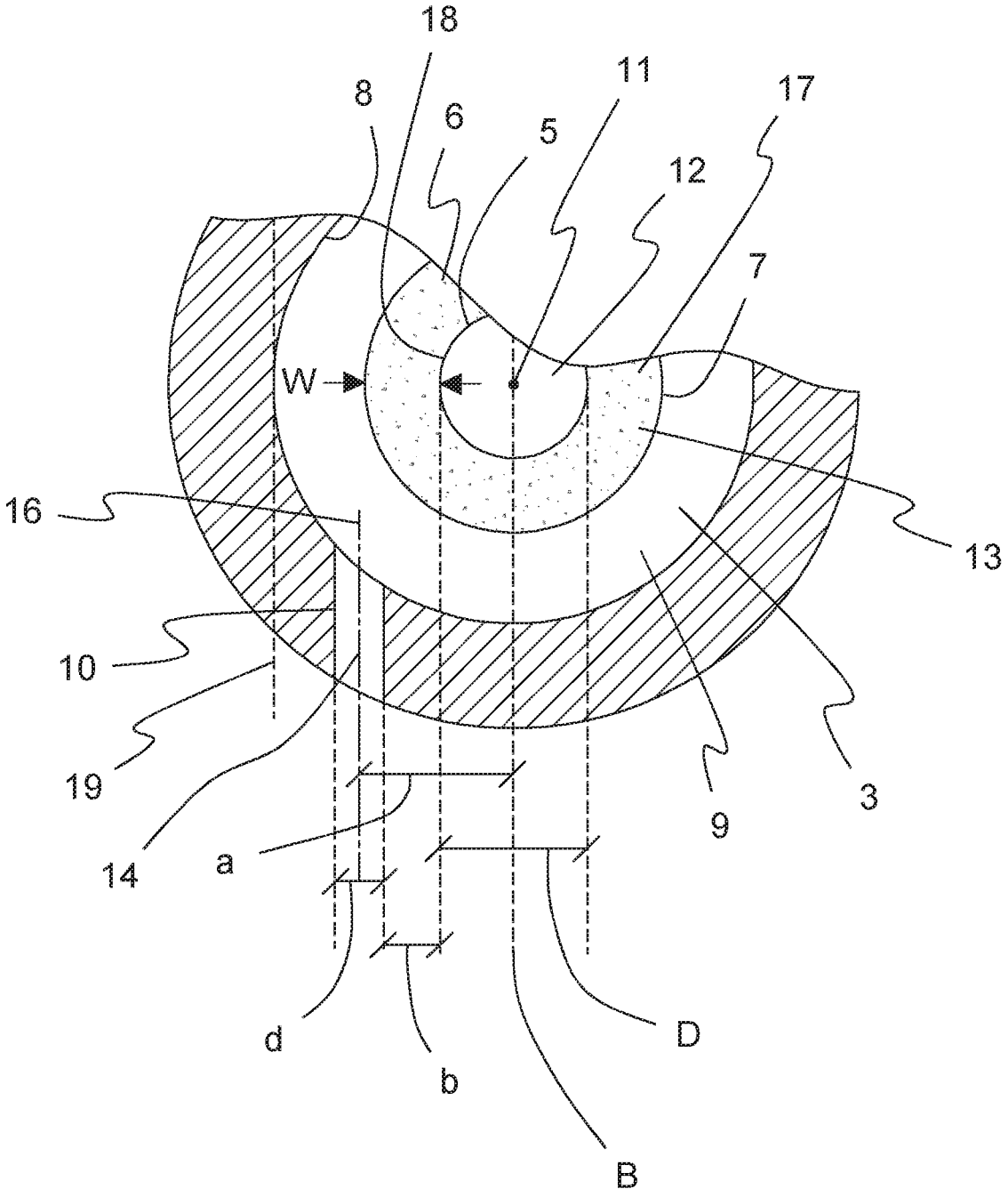
FIG. 6 shows a detail of FIG. 4*a;*

Possible advantageous dimensions are shown in FIG. 6, which for the sake of simplicity shows only a detail of a sectional diagram corresponding to FIGS. 4 and 5.

As explained in the previous description, it is advantageous if the inside diameter D of the draw-off channel 12 in the area of a section downstream from the intake opening 5 of the spindle 6 has a value of 0.4 mm to 3.0 mm in the case of a spindle 6 for spinning traditional yarn or has a value of 2.0 mm to 10.0 mm for a spindle 6 for spinning roving, wherein the inside diameter d of the spinneret 2 should preferably have a value of 0.2 mm to 2.0 mm.

Furthermore, it has also proven advantageous if the shortest distance a between the corresponding central axis 14 and a reference plane B runs parallel to this central axis 14 and contains the longitudinal axis 11 of the draw-off channel 12 (see FIG. 6), said distance running perpendicular to the respective central axis 14 has a value of −0.7 mm to 5.6 mm when spinning traditional yarn and 1.5 to 8.0 mm when spinning roving. This value is in turn comprised of half the inside diameter d of the air jet 10 and half the inside diameter D of the draw-off channel 12 as well as a distance b the value of which is −1.5 mm to 5.0 mm. In particular, b should have a value less than the value of the wall thickness W of the spindle wall 17, which is also identified in FIG. 6.

Finally FIG. 6 shows that the air jets 10 should preferably have a certain value and be arranged with an offset based on a tangent 19 of the inside wall 8 of the eddy chamber 3 in the direction of the longitudinal axis 11 of the spindle 6.

Figure 7A:
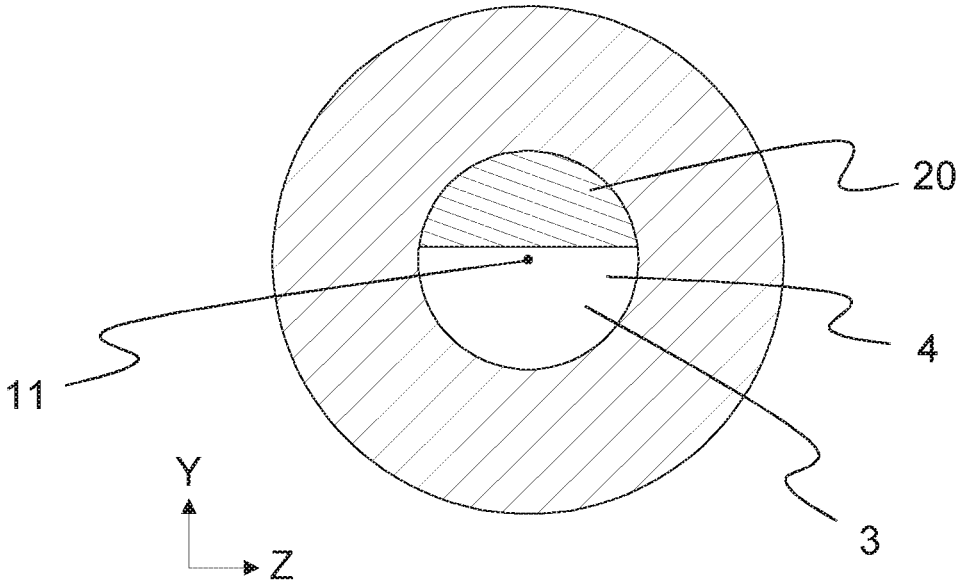
FIGS. 7*a, b* shows a top view of a spinneret in the area of the fiber guide element.
Figure 7B:
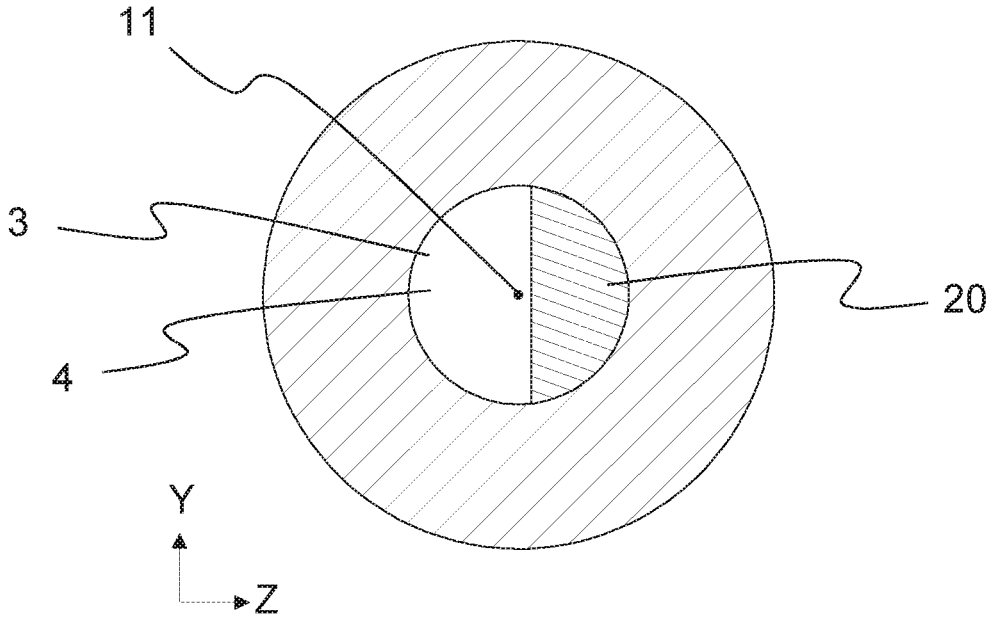
Figure 8:
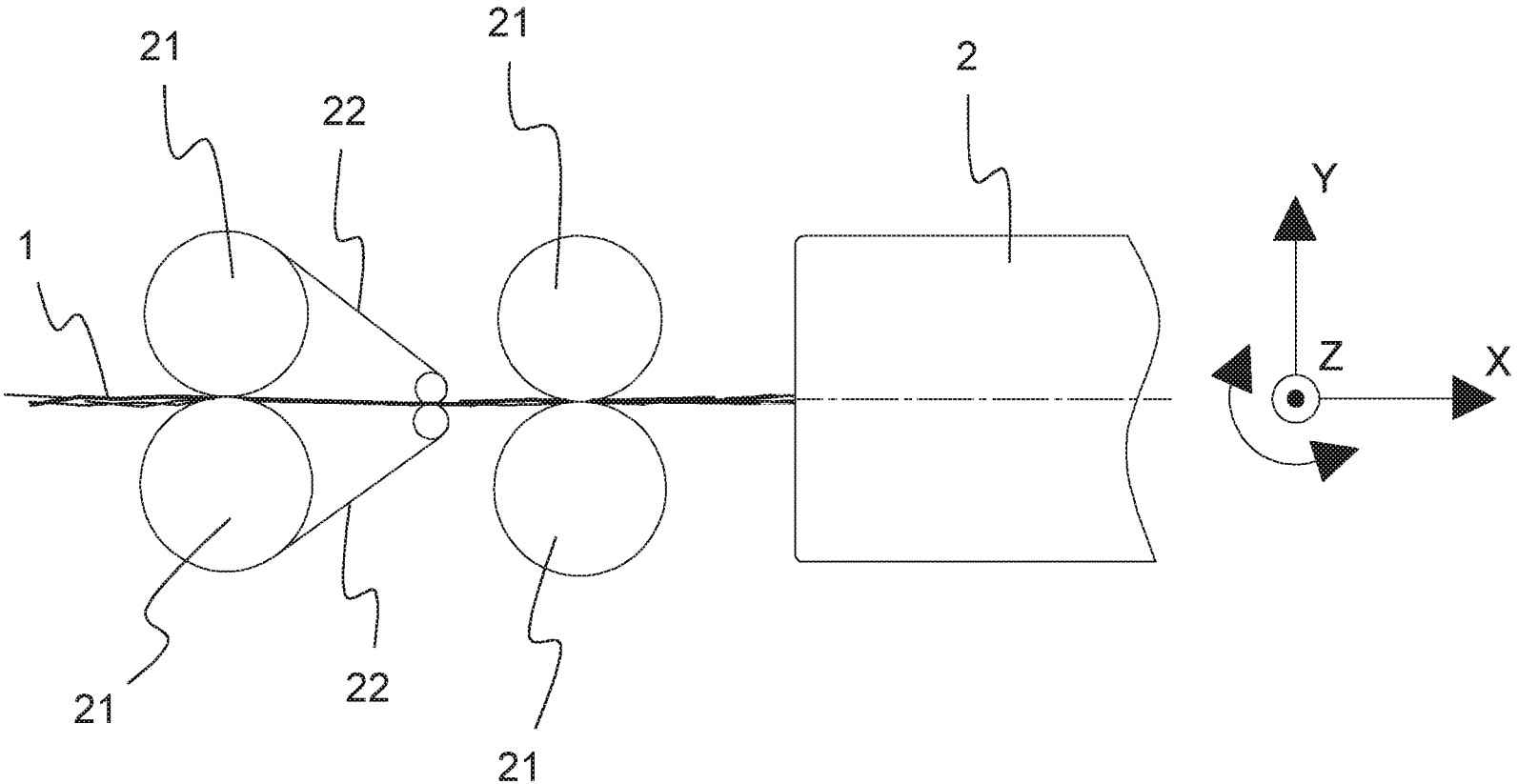
FIG. 8 shows a side view of a detail of an air spinning machine.

In conclusion, reference should be made to FIGS. 7 and 8, which relate to another advantageous aspect of a novel air spinning machine. In this context it should be pointed out that the spatial orientation in most of the figures is represented by a coordinate system, in which the multiple diagrams in the figures are shown with the same angle of view (e.g., FIGS. 1 and 8 and/or 3 to 6 this was omitted for reasons of simplicity).

As shown by a comparison of FIGS. 7*a* (prior art illustrated) and 7*b* (novel), it may be advantageous if the fiber guide element 20 is arranged so that it is rotated about the X axis. In this case, the fiber structure 1 is deflected in Z direction, i.e., in a direction running parallel to the axes of rotation of the drawing mill rollers 21 and soon as the fiber structure 1 has passed through the fiber guide element 20.

In addition or alternatively, it may also be advantageous if the spinneret 2 is tilted about the Z axis out of the position shown in FIGS. 1 and 8, so that the longitudinal axis 11 of the spindle 6 and the transport direction of the fiber structure 1 are no longer parallel to one another within the drawing device, with a corresponding angle of inclination between 0° and 15° being preferred. Finally, it is also conceivable for this spinneret 2 to be tilted about the Y axis or shifted along the Z and/or Y axis. The offset in the direction of the Y axis should amount to max. 10 mm, where the offset is based on the embodiment in which the fiber structure 1 passing through the drawing mill and the longitudinal axis 11 of the spindle 6 are colinear.

Figure 9:
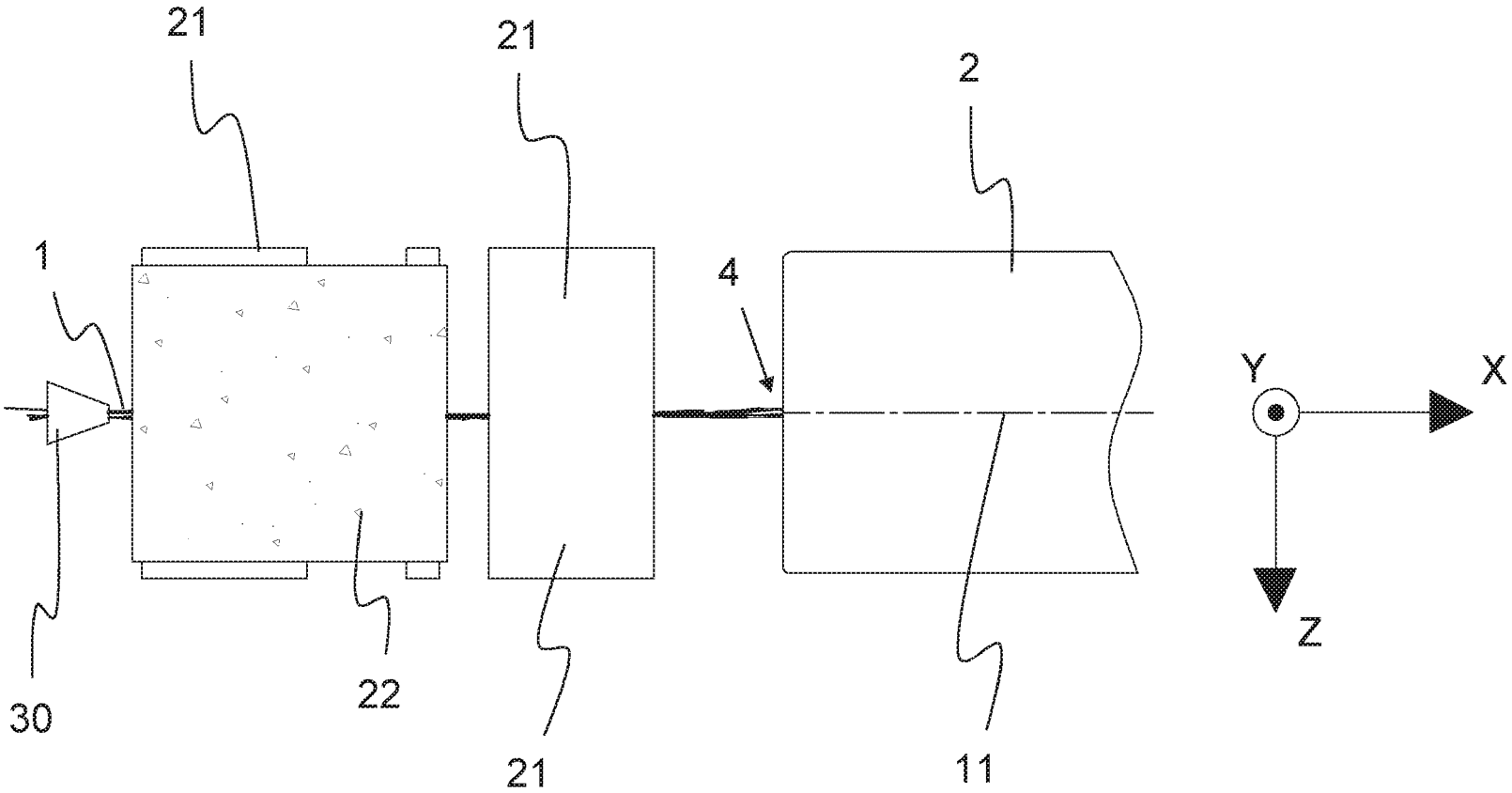
FIG. 9 shows a top view of a detail of an air spinning machine.

In conclusion, reference is made to FIG. 9 in this context. This shows in principle a top view of the detail shown in FIG. 8, wherein a guide 30 is also illustrated for the fiber structure 1. The guide 30 (several of which may also be present) serves the guide the fiber structure 1 on its path in and through the drawing device, wherein the guide 30 ensures that the fiber structure 1 takes its predetermined path on the one hand and on the other hand is compressed laterally to a predetermined extent (for example by a funnel shape of the guide 30).

Furthermore FIG. 9 shows that it has been customary in the past for the spinneret 2 to be placed in such a way that the fiber structure 1 enters the spinneret 2 and/or the intake 4 of the eddy chamber 3 in such a way that it is approximately colinear with the longitudinal axis 11 of the spindle 6.

As already indicated above, however, it may also be advantageous if the spinneret 2 is shifted in the Z axis (upward or downward with respect to FIG. 9) with the same position of the drawing mill rollers 21 in comparison with FIG. 9, wherein the amount of the displacement should preferably be between 2 mm and 30 mm, i.e., the smallest distance between the longitudinal axis 11 of the spindle 6 and a midline of the fiber structure 1 should be between 2 mm and 30 mm.

The present invention is not limited to the embodiments illustrated and described here. Modifications within the scope of the patent claims are equally possible as is any combination of the described features, even if they are illustrated and described in different portions of the description and/or claims or in different embodiments.

LIST OF REFERENCE NUMERALS

1 Fiber structure
2 Spinneret
3 Eddy chamber
4 Intake of the eddy changer
5 Intake opening of the spindle
6 Spindle
7 Outside surface of the spindle
8 Inside wall of the eddy channel
9 Annular gap
10 Air jet
11 Longitudinal axis of the spindle
12 Draw-off channel
13 Front end of the spindle
14 Central axis of the air jets
15 Imaginary extension of the air jet
16 Imaginary extension of the central axis of the air jet
17 Spindle wall
18 Inside surface of the spindle
19 Tangent to the inside wall of the eddy chamber
20 Fiber guide element
21 Drawing device rollers
22 Belt
23 Sleeve
24 Bobbin
25 Draw-off roller
26 Outlet
27 Yarn
28 Air
29 Eddy chamber wall
30 Guide for fiber structure
W Wall thickness of spindle
d Inside diameter of air jet
D Inside diameter of draw-off channel in a cylindrical region adjacent to the intake opening
B Reference plane
S Sectional plane

The invention claimed is:

1. An air spinning machine for producing a yarn from a fiber structure, comprising:

a spinneret with an internal eddy chamber;

an intake to the eddy chamber for admission of the fiber structure;

a yarn-forming element in the spinneret in the form of a spindle having an intake opening, the yarn-forming element extending at least partially into the eddy chamber;

an annular gap formed between an outside surface of the spindle and an inside wall of the eddy chamber facing the spindle;

air jets in the spinneret by means of which air is introduced into the eddy chamber to impart a twist to the fiber structure in a region of the intake opening;

an interior draw-off channel in the spinneret having a central longitudinal axis by means of which the yarn is withdrawn from the eddy chamber;

the air jets aligned in a direction relative to a front side of the spindle around the intake opening so that some of the air introduced via the air jets during a spinning operation enters the annular gap and a remainder of the air enters the draw-off channel; and wherein each air jet comprises a central axis, a shortest distance (a) running perpendicular to the central axis and between the central axis and a reference plane (B) that runs parallel to the central axis and contains the central longitudinal axis of the draw-off channel conforms to the following formula:

$a=d/2+D/2+b$, wherein d corresponds to an inside diameter of the air jet;

D corresponds to an inside diameter of the draw-off channel in a cylindrical region adjacent the intake opening;

b corresponds to a distance between an inside surface of the air jet facing the draw-off channel and an inside surface of the draw-off channel in the cylindrical region facing the air jet;

where a has a value of −0.7 mm to 8.0 mm;

where d has a value of 0.2 mm to 2.0 mm;

where D has a value of 0.4 mm to 12.0 mm; and where b has a value of −1.5 mm to 5.0 mm.

2. The air spinning machine according to claim 1, wherein the air jets run in a plane between the intake opening and a tangent to the inside wall of the eddy chamber, the tangent running parallel to a central axis of the respective air jet.

3. The air spinning machine according to claim 1, wherein b has a value of less than half the inside diameter (D) of the draw-off channel.

4. The air spinning machine according to claim 1, wherein b has a value less than a wall thickness (W) of the spindle in the cylindrical region of the draw-off channel.

5. The air spinning machine according to claim 1, wherein the air jets comprise boreholes with an imaginary straight extension that intersects the spindle.

6. The air spinning machine according to claim 5, wherein the air jets comprise a central axis with an imaginary linear extension that intersects the spindle.

7. The air spinning machine according to claim 6, wherein the imaginary linear extension of the central axis intersects a wall of the spindle without thereby intersecting the draw-off channel.

8. A method for producing a yarn from a fiber structure during a spinning operation with the air spinning machine according to claim 1, comprising introducing aft into the eddy chamber with the air jets during the spinning operation such that some of the introduced air enters the annular gap and the remainder of the introduced air enters the draw-off channel.

9. The method according to claim 8, wherein some of the introduced air strikes a front side of the spindle surrounding the intake opening of the spindle and is thereby distributed by the spindle.

10. The method according to claim 8, wherein most of the introduced air enters the annular gap.

11. The method according to claim 10, wherein a maximum of 30% of the introduced air enters the draw-off channel.

* * * * *